United States Patent [19]

Hodell

[11] 4,096,365

[45] Jun. 20, 1978

[54] ROTARY WAFER SWITCH

[75] Inventor: James Anthony Hodell, Lovedean, England

[73] Assignee: Wessex Advanced Switching Products Limited, Hayling Island, England

[21] Appl. No.: 647,203

[22] Filed: Jan. 7, 1976

[30] Foreign Application Priority Data

Jan. 15, 1975 United Kingdom ..... 1841/75

[51] Int. Cl.[2] ..... H01H 19/58; H01H 9/00

[52] U.S. Cl. ..... 200/11 DA; 200/11 J; 200/14; 200/281; 200/292; 200/307

[58] Field of Search ..... 200/11 R, 11 D, 11 DA, 200/11 G, 11 J, 11 K, 14, 16 C, 280, 281, 290–292, 293–296, 303, 307

[56] References Cited

U.S. PATENT DOCUMENTS

| | | | |
|---|---|---|---|
| 2,956,131 | 10/1960 | Tabet | 200/307 X |
| 2,988,607 | 6/1961 | Tabet | 200/11 DA |
| 3,391,259 | 7/1968 | Massengale | 200/11 R |
| 3,525,827 | 8/1970 | Allison | 200/303 X |
| 3,571,534 | 3/1971 | Ashman | 200/296 X |
| 3,594,527 | 7/1971 | Brant et al. | 200/293 X |
| 3,689,714 | 9/1972 | Walz | 200/281 X |
| 3,917,921 | 11/1975 | Jakubauskas | 200/333 |
| 3,983,352 | 9/1976 | Ellis, Jr. et al. | 200/11 J |

FOREIGN PATENT DOCUMENTS

| | | | |
|---|---|---|---|
| 2,225,066 | 6/1974 | Germany | 200/11 DA |
| 2,152,128 | 4/1973 | Germany | 200/11 DA |
| 270,122 | 11/1950 | Switzerland | 200/294 |
| 805,412 | 12/1958 | United Kingdom. | |

OTHER PUBLICATIONS

Plessey Printswitch Catalog; Pub. No. 4283; 2–1969; Pertinent Pages–Kit Assembly.

*Primary Examiner*—James R. Scott
*Attorney, Agent, or Firm*—Cooper, Dunham, Clark, Griffin & Moran

[57] ABSTRACT

A rotary wafer switch in which the switch housing is resilient and insulating so that the wafers can be snap-fitted into it and in which the rotatable contact-carriers are provided with apertures through which the contacts in the carriers can be removed if desired after the switch has been assembled.

6 Claims, 19 Drawing Figures

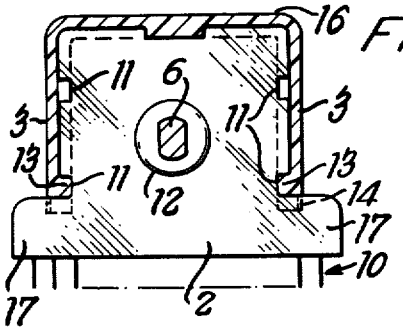
Fig. 3
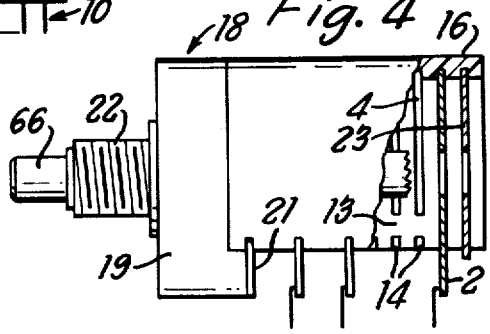
Fig. 4
Fig. 7
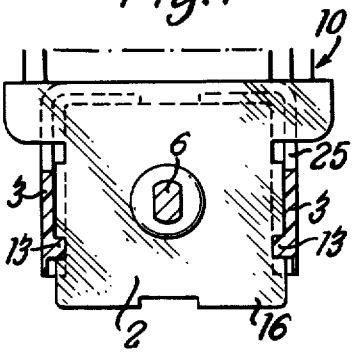
Fig. 6
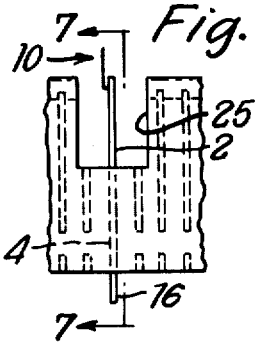
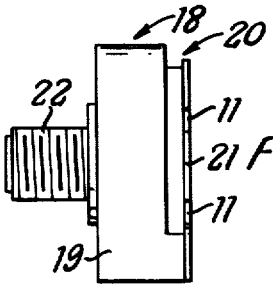
Fig. 5

ROTARY WAFER SWITCH

FIELD OF THE INVENTION

This invention relates to rotary wafer switches, which are sometimes also referred to as multi-position rotary switches.

BACKGROUND OF THE INVENTION

A widely used type of rotary wafer switch has the following construction. A plurality of wafers which are approximately rectangular and which each carry a plurality of contacts arranged in an annular fashion are mounted parallel with each other transversely across the interior of an aluminum alloy wafer housing which is U-shaped in cross-section (the bottom of the U being flat) and which is substantially longer than it is wide. Co-operating with each wafer there is a circular contact carrier which carries one or more movable contacts and all the contact carriers are rotatable together by means of a common shaft which extends longitudinally of the housing through all the carriers. At one end of the housing there is mounted an indexing mechanism which has an operating knob for turning the shaft. At the other end of the housing there is an end plate which serves to keep the two side walls of the housing tied together at that end. The indexing mechanism serves to define a plurality of different angular positions to which the shaft may be set, thereby setting all the contact carriers to corresponding positions. In the different positions, the movable contacts on the contact carriers make contact with different ones of the fixed contacts on the respective wafers. The fixed contacts on the wafers are connected to terminals on the wafers so that a multitude of electrical circuits connected to these contacts can be made, or broken, in various different combinations depending on the position to which the switch is set. It is believed that the operation of the switch need not be described further since it is very well known in the art.

As regards the switch construction, each wafer has applied to its opposite edges an insulating plastics member. Its contact carrier is then secured adjacent the contact-carrying face of the wafer. This sub-assembly is then positioned across the interior of the wafer housing, which is slightly spread at this stage to facilitate insertion of the sub-assembly and normally several other similar sub-assemblies at the same time. The side and bottom walls of the housing have holes in them and the insulating pieces on the edges of the wafers have corresponding projections which fit into the holes. When all these sub-assemblies have been placed in position they have to be held in position while the side walls of the housing are squeezed inwards to firmly engage the insulating pieces and thereby properly locate and retain the wafers. The insulating pieces are required between the wafer edges and the housing because conductive paths on the wafers come quite close to the wafer edges and there would otherwise be a possibility of short-circuiting inadvertently occurring between these paths and the metal housing.

As regards the movable contact carriers, these are such that once the contacts have been inserted in them and the carriers have been secured to their wafers to form a sub-assembly, the contacts can no longer be removed from them. Consequently, once the whole switch has been assembled it will have to be completely dis-assembled if it is then found that one or more of the movable contacts in one of the contact carriers has been mis-positioned.

It will be appreciated from the above that assembly of the prior art type of switch is not simple, the number of parts required is quite large, special tooling is required for efficient assembly, and the rectification of any mistakes made in inserting the movable contacts requires complete dis-assembly of the switch.

SUMMARY OF THE INVENTION

An object of the present invention is to provide an improved rotary wafer switch.

From one aspect there is provided a rotary wafer switch comprising a wafer housing, at least one wafer positioned in the housing and carrying fixed switch contacts, a rotatable contact carrier carrying at least one movable switch contact which co-operates with said fixed switch contacts, and means for automatically retaining the wafer in position in response to it reaching its operative position in the housing when the wafer is assembled into the housing.

Assembly of the switch is thereby greatly facilitated because once each wafer has been fully inserted it becomes locked into its inserted position. It does not need to be held in position by any other means while the other wafers are being placed in position, and neither does the housing itself have to be operated on in any way after all the wafers have been positioned, in order to retain them.

The wafer may have a notch on at least one of its sides adjacent one of said wall portions, and said wall portion will then have a part which snaps into the said notch. In the preferred embodiment which will be described below, the wafer has notches on two opposite sides and both wall portions have ribs which snap into the notches. However, it is possible to provide a notch on only one side of the wafer which engages with a rib on only one of the wall portions of the housing, though of course the location of the wafer will not then be quite as firm. Also, the notch could be replaced by a projection, in which case the housing wall would have a slot into which the projection would snap, rather than a rib.

The wafer may have terminals along an edge portion thereof and be adapted to be positioned in the housing with said edge portion exposed from the housing either in one direction or in the opposite direction. This aspect will become clearer from the description which follows, and it makes the switch more adaptable in use.

This advantage of the particular construction to be described can also be obtained by different constructions by ensuring that the inter-engaging parts of the wafer and the housing have suitable symmetry with regard to the two opposite directions in which the terminals are desired to be exposed.

The wafer housing is preferably an insulating housing. This may be achieved by moulding it from plastics material such as glass-fibre reinforced Nylon or using a plastics-coated sheet metal, preferably spring steel. Making the housing itself of such an insulating material avoids the necessity of special insulating pieces interposed between the wafer edges and the casing, as has been done in the prior art. Consequently, the number of parts required for the switch is reduced and assembly is simplified. To achieve comparable simplicity using a metal wafer housing, each wafer would have to be provided with substantial margins free from conductive paths and this would require an increase in the size of the housing as compared with what may be achieved using the aspect of the invention just referred to.

Preferably each of the wall portions is formed on its inside with a plurality of parallel wafer-locating members, said wafer being located by an opposed pair of said members. In the preferred embodiment the wafer-locating members are channels, but alternatively small projections may be provided on the inside of the wall portions, in line with each other so that the edges of a wafer can be slid between adjacent projections thereby to locate the wafer.

A further feature is that the or each rotatable contact carrier is adapted to permit removal of the movable switch contact or contacts therefrom while the carrier is in its operative position. Thereby, after the switch has been fully assembled, any incorrectly placed movable contacts in the contact carriers may be extracted and replaced in correct positions, without the switch being dis-assembled.

The invention also provides in a further aspect a contact carrier for a rotary wafer switch, comprising a substantially circular body having a plurality of contact housings spaced around it, each contact housing having an opening at the radially outward end thereof, through which a contact can be removed from its housing. The term "radially outward end" is used in thic context merely to distinguish the radially outward end from the radially inward end and not to imply that the opening must face precisely in the radially outward direction. In the preferred embodiment the opening in fact faces to some extent in an axial direction.

Rotary wafer switches are often sold in kit form for assembly by the user. Complexity of assembly and the use of special tooling for assembly is a particular disadvantage in these circumstances. The invention from a further aspect provides a kit of parts for making a rotary wafer switch according to the invention as already described, thereby enabling simpler assembly of rotary switches by a user who is doing the assembly work himself.

In order that the invention may be more clearly understood, some embodiments thereof will now be described, by way of example, with reference to the accompanying drawings.

BRIEF DESCRIPTION OF THE DRAWINGS

FIG. 3 shows a cross-section on the line 3—3 of FIG. 2;

FIG. 4 shows a side view, partly cut away, of the embodiment of FIGS. 2 and 3;

FIG. 5 shows separately the indexing mechanism of the embodiment of FIGS. 2, 3 and 4;

FIG. 6 shows how a wafer may be fitted to a switch in a reversed orientation;

FIG. 7 is a cross-section on the line 7—7 of FIG. 6;

DESCRIPTION OF THE EMBODIMENTS

Figure 1:
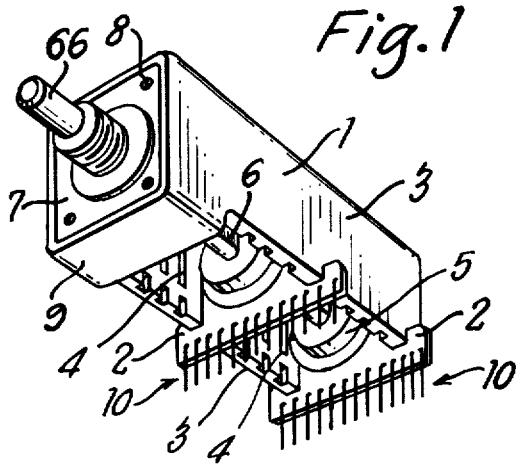
FIG. 1 shows a perspective view from below of one embodiment of the invention.
Figure 2:
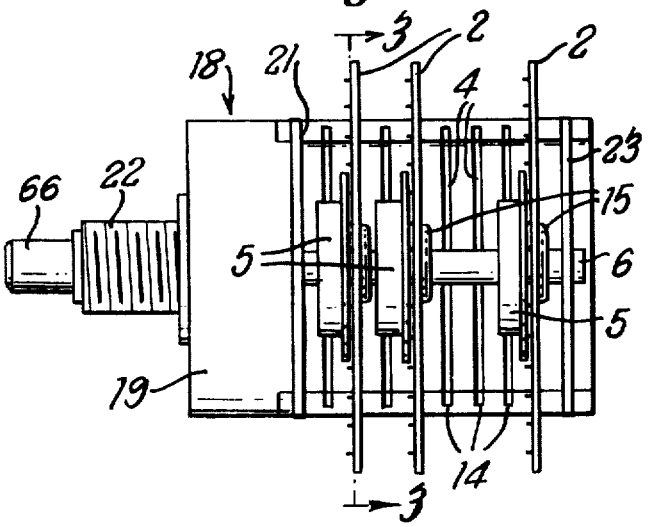
FIG. 2 shows a plan view from below of a second embodiment of the invention.

The overall construction of a rotary wafer switch in accordance with the invention will first be outlined with reference to FIG. 1.

The switch comprises a wafer housing 1 which is moulded in one piece from insulating plastics material and which is U-shaped in transverse cross-section, the limbs of the U forming opposed wall portions 3 and the base of the U forming a top of the housing which is not visible in FIG. 1. The insides of each of the wall portions 3 are formed with a plurality of parallel wafer-locating members in the form of channels 4.

The wafers 2 are located and automatically retained in opposed pairs of the channels 4 in a manner which will be more fully described, so that they are disposed parallel to each other and transversely between the wall portions 3. A typical wafer 2 will be described in more detail below.

Respective rotatable contact carriers 5 are associated with each of the wafers 2 and each contact carrier carries at least one movable switch contact which co-operates with fixed switch contacts on the wafers. Both of the contact carriers 5 are rotatable by means of a common shaft 6 which extends through both of them and, at the front of the switch, into an indexing mechanism 7 which in this embodiment is retained, for example by means of screws 8, in a housing 9 which is moulded in plastics material integrally with the wafer housing 1 and at the front end thereof.

In well known manner, each of the wafers 2 is provided at its exposed edge with a plurality of tags 10 which are connected in conventional manner to printed circuit paths on the wafers, as will be described in more detail below. It will be appreciated that the tags 10 can be inserted directly into a "mother" printed circuit board or suitable connectors on a printed circuit board, again in well known manner. Normally a knob (not shown) will be provided on the front end of shaft 6 so that by turning the knob the contact carriers 5 can be set to various different positions, as determined by the operation of the conventional indexing mechanism 7, which will cause various combinations of the tags 10 to be connected together, or not, depending on the position of the knob.

A further embodiment will now be described in more detail with reference to FIGS. 2 to 5, which differs from the FIG. 1 embodiment in that the indexing mechanism is formed as a separate unit which fits at the front of the wafer housing 1. In these Figures it can be seen that the channels 4 extend at least partly across the bottom of the U-shaped cross-section of the housing 1 which, in use, normally forms the top of the switch since the switch will be installed with this part upwards in order to minimise the entry of dust and other foreign bodies into the switch mechanism. It can also be seen, from FIG. 3, that each wafer 2 is provided with four notches 11, two on each of its sides which are adjacent the wall portions 3 of the housing, and a central aperture 12 through which the shaft 6 can freely pass.

Close to the free edge of each of the wall portions 3 of the housing a rib 13 is moulded, the rib extending in the axial direction of the switch. On each wall portion, between the free edge of the wall portion and the rib 13, a plurality of thin portions 14 are moulded in line with respective ones of the channels 4. The thin portions are in fact in the form of what is known as "flash" which the mould used for production of the housing 1 is deliberately arranged to produce in the desired location.

In assembly, first the desired number of sub-assemblies, each consisting of a contact carrier 5 including its contacts, and a wafer 2 to which the carrier 5 is rotatably secured by means of a collar 15, are prepared. Then, the wafers of these sub-assemblies are inserted into the housing in the following manner. The leading edge portion 16 of the wafer is first inserted between an opposed pair of the thin portions 14 of the two walls 3. The wafer is then pushed into the housing edge-wise and transversely of the housing so that the side walls 3 become resiliently spread apart to a certain extent as the leading end of the wafer rides over and between the two opposed ribs 13. Next, the uppermost (as viewed in FIG. 3) two notches 11 come opposite the ribs 13 and the resilience of the housing causes the walls 3 to snap towards each other so that the ribs 13 enter this pair of notches 11. By slightly spreading apart the side walls, the movement can be continued with the wafer margins guided in the channels 4 until the leading edge 16 of the wafer enters the portions of the channels 4 which run transversely of the housing. At this time, the lowermost pair of notches 11 (as seen in FIG. 3) come opposite the ribs 13 and again the resilience of the housing causes the walls to snap in towards each other and the ribs 13 enter these notches 11, thereby automatically retaining the wafer in its fully-inserted or operative position in response to its reaching that position. During the final stage of the above-described insertion process, the two oppositely laterally projecting parts 17 of the wafer are pressed in to the thin portions 14 at the edges of the housing walls 3 and break these portions away so as to form therein depressions which snugly locate the wafer. In practice, the wafers are normally available in slightly different thicknesses and the thin portions 14 will only be broken down over a distance corresponding with the actual thickness of the wafer being used. That is to say a thin wafer will make only a corresponding narrow depression in the thin portion 14 whereas a thicker wafer will make a wider depression in the thin portion 14. Thus a snug fit is achieved irrespective of wafer thickness within a certain tolerance.

The indexing mechanism 18 is then fitted. The mechanism has a moulded plastics housing 19 which has a rear portion 20 (see FIG. 5, which shows the mechanism before an operating shaft 66 has been fitted) formed integrally therewith which comprises a plate 21 the shape of which corresponds with that of a wafer 2, so that the plate 21 includes similar notches 11 to those of a waver. These features may also be seen, in plan from the rear, in FIG. 19. The plate 21 may be of plastics material and formed in the same moudling operation as the housing 19, or may be of metal, in which case preferably the plate is adapted to have the housing 19 secured firmly onto it. The indexing mechanism 18 is normally mounted at one end of the wafer housing 1 (in principle a similar mechanism may be anywhere between the two ends) by sliding the plate 21 into the endmost pair of channels 4 in the housing in the same way as has already been explained in respect of the wafers 2. When the plate 21 has been fully pushed into the housing the opposed walls of the housing snap inwards so that the ribs 13 engage in the uppermost pair of notches 11 (as viewed in FIG. 5) in the plate 21, thereby automatically retaining the indexing mechanism in position at the front of the housing. The front of the indexing mechanism is provided with a threaded bush 22 by means of which the fully assembled switch may be mounted behind a panel in known manner.

Next an end plate 23, again having a shape corresponding to that of a wafer, is pushed into the endmost pair of channels 4 at the opposite end of the wafer housing until it snaps into the fully-inserted position. The end plate 23 may be of plastics or metal material. If the plate 21 on the indexing mechanism, and the plate 23, are both of metal, such as aluminium alloy, they can be "staked" to both side walls so as to positively tie together the two side walls and thereby minimise the possibility of the side walls spreading apart during use of the switch, though in practice we have found this unnecessary. "Staking" involves using a sharp tool to penetrate the edge of the plate very close to the plastics material of the housing, thereby forming a narrow piece of metal still attached to the plate, and bending this narrow piece over so that it engages firmly with the plastics material of the side wall 3. This can be done if necessary at both sides of the plate 21 and the plate 23.

Next, the shaft 6 is inserted through the central aperture in the rear plate 23, and the central apertures in all of the contact carriers 5, and its leading end is fitted into the indexing mechanism 18 so that shaft 6 becomes rotatable by rotating an operating shaft 66 at the front of the indexing mechanism; shaft 6 is then firmly located axially. Means for doing this are not shown, but various techniques are well known. One involves having an annular groove around the shaft 6 at its rear end, fitting a special bushing into the aperture in the plate 23 through which the end of the shaft 6 projects, fitting a circlip in the annular groove on the shaft 6, and then retaining the circlip in the bushing so that the bushing prevents axial movement of the circlip and hence of the shaft 6. We have found that an alternative way of axially locating the shaft 6 is to use a bushing of top-hat cross-section, having a closed end, which is inserted through the aperture in the end plate from the inside. This way be used, for example, in the FIG. 1 construction. The sub-assemblies are fitted into the housing, tne end plate fitted, the top-hat section bush inserted into the end plate, the shaft 6 inserted through the sub-assemblies until its leading end enters the central recess of the bush, and then the indexing mechanism 7 is fitted into its housing 9, engaging over the end of the shaft 6, and is retained by the screws 8.

Turning now to FIGS. 6 and 7, these show how a wafer can be inserted in the housing with its terminal edge, carrying the tags 10, exposed through the top of the housing rather than at the bottom of the housing as has hitherto been illustrated. In order to do this, a section is cut out of the top of the housing as shown at 25 and the edge 16 of the wafer 2 is inserted through the cut-out portion so that the side edges of the wafer engage in an opposed pair of the channels 4. Upon continued insertion, the pair of notches 11 nearest the edge 16 snap over the ribs 13, thus automatically retaining the wafer 2 in position. Because this pair of notches 11 are the same distance from a plane passing through the axis of the shaft 6 perpendicular to the walls 3, as are the other pair of nothces 11, the annular arrangement of contacts on the wafer 2 will still be concentric with the centre of the shaft 6, despite the inversion of the wafer 2.

Figure 8:
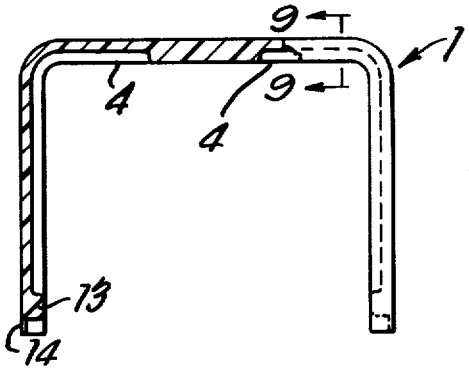
FIG. 8 is a transverse cross-section through the wafer housing in greater detail.

FIG. 8 is a scale drawing of the housing 2 seen from one end, and taken partly in cross-section through an opposed pair of channels 4. The outside dimension of the housing is 27 mm, the total wall thickness being 1.6 mm, the wall thickness inside a channel being 0.8 mm and the thickness of the thin portions 14 being between 0.1 and 0.2 mm. During or after moulding the side walls are given a slight "toe-in" to improve their grip on the wafers.

Figure 9:
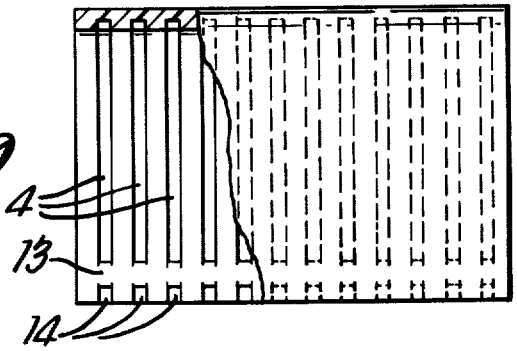
FIG. 9 is a cross-section taken on the line 9—9 in FIG. 8.

FIG. 9 is again a scale drawing of the same housing shown in FIG. 8, taken partly in cross-section on the line 9—9 of FIG. 8, the distance between centres of successive channels 4 being 1.54 mm (0.1 inches) and the width of each channel being 0.85 mm.

Figure 10:
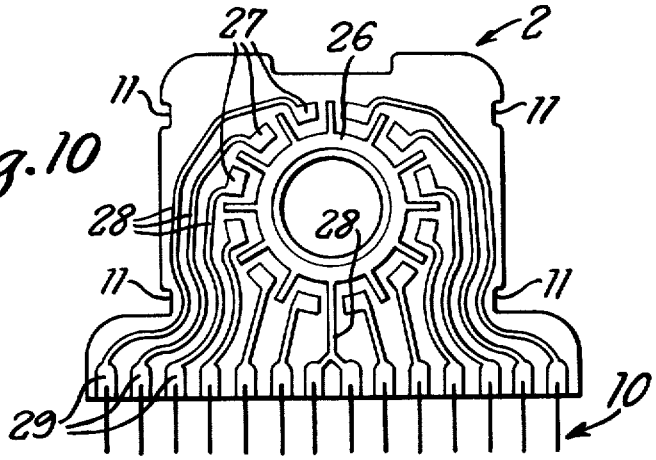
FIG. 10 shows a wafer in detail.

FIG. 10 shows a typical wafer 2 and one example of a layout of fixed contacts and conductive paths leading to the terminals, which may be printed on the wafer. It can be seen that there is a single annular inner contact 26 and a plurality of outer contacts 27 also arranged in annular form. The contacts 26 and 27 are connected by means of various printed conductive paths 28 to respective printed terminals 29. Any suitable form of connecting means may be secured to the terminals, for example by soldering, and the Figure shows tags 10 in the form of pins. The printed circuit wafer is shown in FIG. 10 on the same scale as FIGS. 8 and 9. The distance between the main side edges of the wafer is 25.2 mm, the width of each of the notches 11 is 1.8 mm and each notch is approximately 0.8 mm deep.

Figure 13:
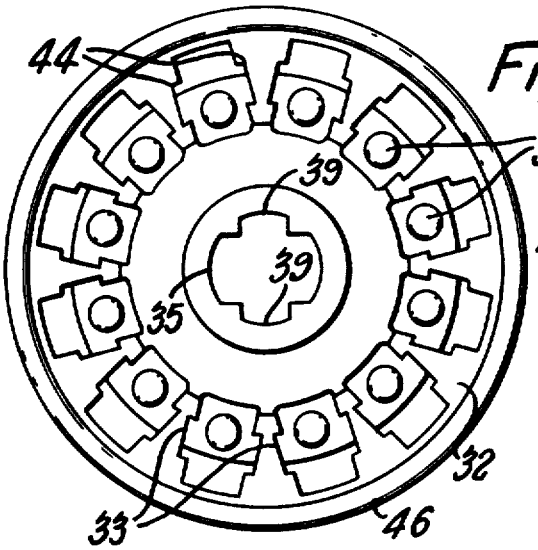
FIG. 13 is a view of the carrier of FIG. 11 taken in the direction of the arrow B in FIG. 11.
Figure 11:
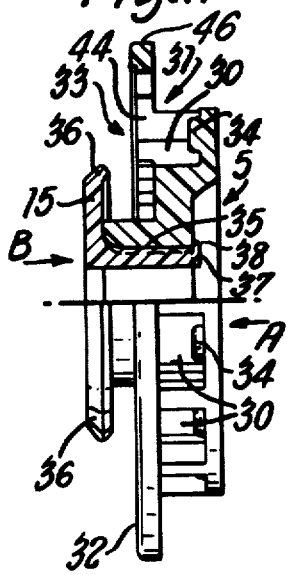
FIG. 11 is a partly cross-sectional view of a rotary contact carrier.
Figure 12:
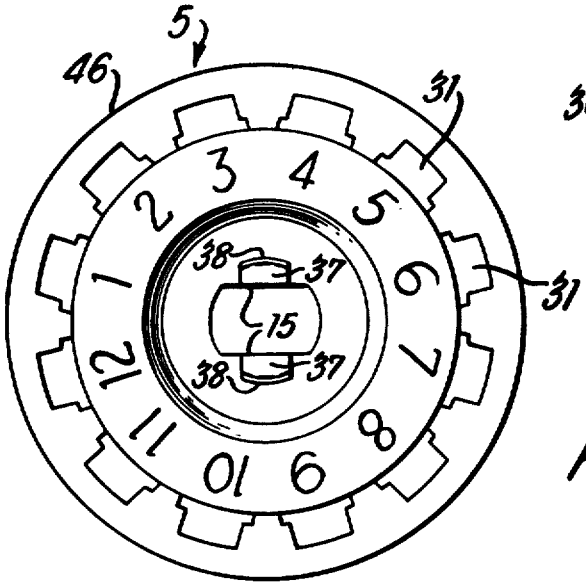
FIG. 12 is a view of the carrier of FIG. 11 taken in the direction of the arrow A in FIG. 11.
Figure 18:
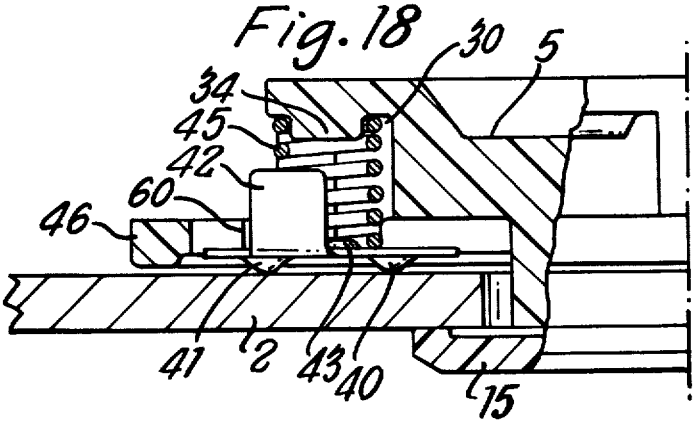
FIG. 18 shows a contact in position in the rotary contact carrier.

FIGS. 11 to 13 are drawn to a different scale and show a contact carrier 5 having an outside diameter of 19 mm. FIG. 12 shows a view taken in the direction A of FIG. 11 and FIG. 13 is a view taken in the direction of arrow B in FIG. 11. It can be seen that the carrier has twelve contact housings 30 equally spaced around it, though in these Figures contacts are not shown in any of the housings. The number of housings 30 is not critical. Each contact housing 30 has an opening 31 at the radially outward end thereof through which a contact can be inserted and removed, as will be further explained below. The openings 31 do not face directly radially but face partly radially and partly axially in the direction of arrow B in FIG. 11. On the axially facing side 32 of the carrier 5 each of the housings 30 has an opening 33 at which a contact in the housing is exposed to contact the wafer 2, as is more clearly shown in FIG. 18. That wall of each of the housings 30 which is opposite the opening 33 is formed with a small projection 34 which serves to locate one end of a biassing coil spring as shown in FIG. 18. Preferably, as shown in FIG. 12, numbers are marked adjacent each of the housings 30 so that a person assembling contacts into the housing can be instructed to place the contacts in, for example, housings 4, 9 and 12, thus facilitating assembly.

FIG. 13 shows the shape of the central aperture 35 in the carrier 5 and FIGS. 11 and 12 show the collar 15 which is employed to secure the carrier to a wafer 2.

The collar 15 has a circular head 36 from which two arms 37 project axially, the arms having outwardly directed projections 38 at their ends. The arms 37 are spaced apart so that they can be inserted in the direction of the arrow B into the two notches 39 on the opposite sides of aperture 35. At the time of insertion the wafer 2 will be positioned in register with the carrier 5 so that the periphery of the central aperture of the wafer becomes held between the carrier 5 and the head 36 of the collar 15. The shaft 6 has a cross-section with two flat sides corresponding to the aperture which is left when the collar 15 has been inserted into the carrier 5, as shown in FIG. 12. Consequently, when the shaft 6 is pushed through the central aperture in the carrier/collar assembly it ensures that the two arms 37 are kept pushed apart so that the projections 38 are held behind the carrier 5, and consequently the carrier/wafer/collar sub-assembly cannot come apart once the shaft has been inserted through it.

Figure 14:
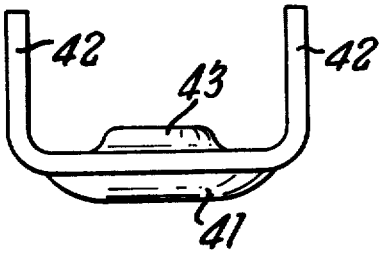
FIG. 14 shows an end view of a movable contact.
Figure 15:
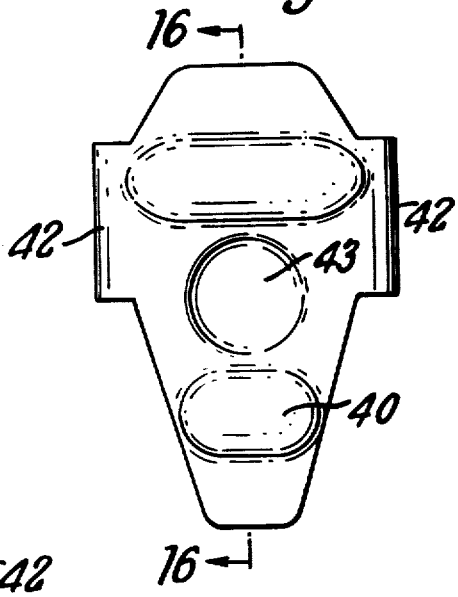
FIG. 15 shows a plan view from below of the same contact.
Figure 16:
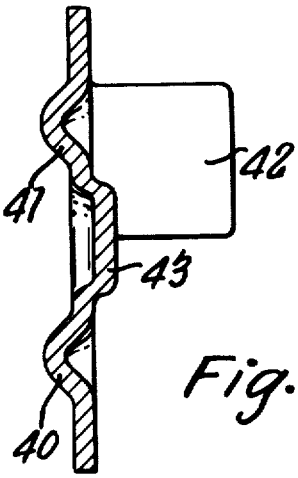
FIG. 16 shows a cross-section of the contact taken on the line 16 of FIG. 15.

FIGS. 14, 15 and 16 illustrate a movable contact which is to be housed in one of the housings 30 of the carrier 5. The contact is shown to scale and has a maximum width of 2.65 mm and a length of 4.1 mm. At the narrower end of the contact there is a protrusion 40 for moving round in contact with the inner fixed contact 26 on the wafer. Near the other end of the contact is a wider protrusion 41 for moving round in contact with the outer contacts 27 on the wafer. The contact is also formed with two ears 42 which help to keep it in the proper alignment when it is within a housing 30 in the carrier 5. Approximately at the centre of the contact there is a projection 43 which locates the opposite end of the biassing coil spring which has already been referred to and which is shown in FIG. 18.

Figure 17:
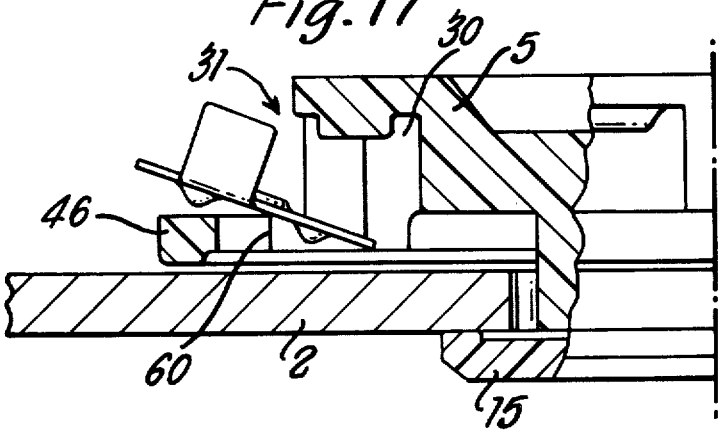
FIG. 17 illustrates how a contact is inserted into or removed from the rotary contact carrier.
Figure 19:
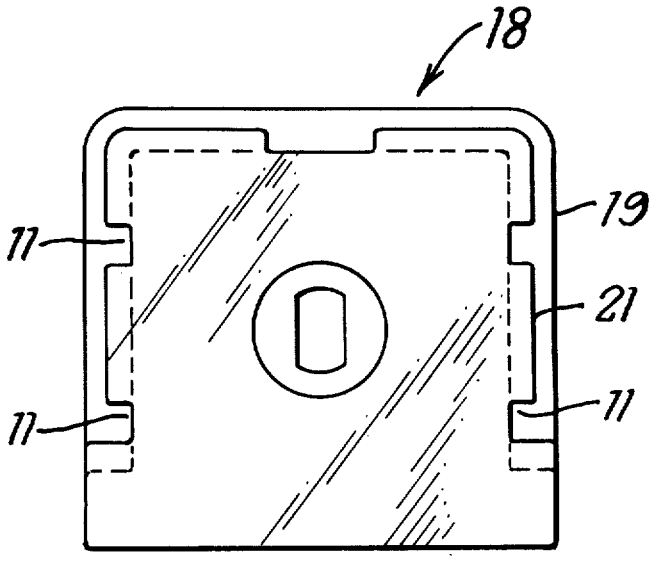
FIG. 19 shows a plan view of the rear of an indexing mechanism, as viewed from right to left in FIG. 5.

FIGS. 17 and 18 show a carrier 5 and a collar 15 assembled together with a wafer 2 assembled in between them so as to form a sub-assembly as already referred to. FIG. 17 shows a movable contact being inserted into one of the contact housings 30 through the opening 31. When the contact is fully inserted as shown in FIG. 19 the ears 42 of the contact become located in the opposed broad grooves 44 in the side walls of the housing 30, which grooves are shown in FIGS. 11 and 13. The contact is thus located, and can be pushed round by the walls of these grooves acting on the ears 42. A small biassing spring 45 is then inserted and located over the projection 34 on the carrier 5 at one end and over the projection 43 on the contact at the other end, so as to bias the contact against the fixed contacts on the wafer 2. For simplicity, the fixed contacts are not shown in FIGS. 17 and 18 but it will be evident that the protrusion 40 bears on the inner fixed contacts 26 while the protrusion 41 bears on one of the outer fixed contacts 27, depending upon the angular position of the carrier 5 relative to the wafer 2.

Even after the switch has been fully assembled in the manner which has already been described, it is still possible to extract any of the movable contacts from its contact housing 30 by inserting the tip of a small tool such as small tweezers through the radial opening 31 and gently levering the contact out through that opening. It can then be positioned in a different housing 30 by inserting it in the manner shown in FIGS. 17 and 18, again without dis-assembling the switch. It should be noted that the radially outward edges of the ears 42 bear against the radially outward walls 60 of the grooves 44 when the contact is fully located in its housing. This prevents escape of the contact in the radially outward direction in use.

The wafers referred to in the specification are in the form of printed circuits but the term "wafer" is not intended to be limited to this construction but may include any substantially flat plate carrying contacts on one of its surfaces.

In prior art constructions, because the manner of mounting the wafers in their housing was rather bulky in the axial direction, wafer positions were not provided more closely spaced than 0.2 inches. The "slide-in" type of wafer fitting disclosed herein occupies less space in the axial direction and therefore wafer positions can be provided at 0.1 inch intervals. The provision of wafer locations at this small spacing does provide more flexibility as to how the wafers may be arranged in any particular application and thus makes the switch more adaptable.

It has been mentioned that rotary wafer switches are sold in kit form. It is usual for the user to cut the wafer housing to a length which will accommodate the desired number of wafers, without being excessive. Wafer housings made of plastics material as herein disclosed are especially suitable for this purpose since the plastics material is easier to cut than metal and the channels 4 guide the cutting saw on an accurate transverse line and also provide a thinned transverse region which makes the cutting even easier.

It is usual for the terminals of all the wafers to be exposed at the same side of the switch, as illustrated in FIG. 1. However, there are occasions when the arrangement of circuits around the switch makes it desirable for some terminals to be exposed on the opposite side of the switch. In those circumstances the arrangement shown in FIGS. 6 and 7 is used and it will be appreciated that a plastics material wafer housing again facilitates cutting of the cut-out portion 25 for that purpose.

It should be mentioned that the important parts of the wafer sofar as retention in the housing is concerned, are the shoulders at the upper sides of the lower pair of notches 11 as viewed in FIG. 3. The wafer will be retained provided these shoulders are present, even though a complete notch may not be present.

It will be evident that where the term "U-shaped" is used herein, it is not intended to specify a recise form, but merely a form in which there are two side limbs joined adjacent one end by a member brdging the two.

Although embodiments have been described in which "snap-in" retention is provided at both sides of the wafer, it is possible to have this only on one side. Provided one side of the housing has a portion such as a rib 13 and the corresponding side of the wafer has a co-operating portion such as a notch 11, then that side of the housing will snap towards the other side when the wafer has been fully inserted and will thus automatically retain the wafer in position.

Normally in the type of switch construction described the wafer carries an arrangement of a relatively large number of fixed contacts and the movable contact carrier carries a relatively small number of movable contacts, for example one or two. However, for some applications an inverse arrangement may be required. In such cases the contact carrier may be in the form of a plate which rotates with the shaft and carries on one face a relatively large number of contacts in printed circuit form. The adjacent face of the wafer will then carry, for example, two fixed contacts which instead of being in printed circuit form may be in the form of wipers resiliently biassed towards the rotatable contact carrier to co-operate with the contacts thereon.

In a further modification, one or both of the housing walls 3 may be slotted right through in between adjacent channels 4 to provide axially separated portions of that wall or the walls. Each portion can then flex separately from the adjacent portions so that insertion or removal of a wafer will not substantially spread the parts of the walls 3 which are retaining an adjacent wafer and hence the retention of an adjacent wafer will not be substantially disturbed.

We claim:

1. A rotary wafer switch comprising a wafer housing, at least one wafer positioned in a predetermined operative position in the housing, said wafer carrying fixed switch contacts, a rotatable contact carrier, at least one movable switch contact carried by the carrier to co-operate with said fixed switch contacts, and co-operating means on the wafer and on the housing for automatically retaining and positively locating the wafer in said predetermined operative position when the wafer reaches said position in the housing when the wafer is assembled into the housing, the wafer comprising terminals along an edge portion thereof, the wafer being adapted to be positioned in the housing with said edge portion exposed from the housing selectively in either of two mutually opposite directions, the housing having two substantially parallel opposed wall portions, the wafer extending transversely between said two opposed wall portions and having two notches on at least one side thereof, at least one said wall portion having a part that snaps into a said notch to retain the wafer, said two notches being equally spaced from a plane through the axis of rotation of the contact carrier perpendicular to said opposed wall portions, whereby when the wafer is positioned with said edge portion exposed in one direction one of the notches engages with said wall portion part and when the wafer is positioned with said edge portion exposed in the opposite direction the other of the notches engages with said wall portion part.

2. A switch as claimed in claim 1 wherein the wafer has such notches on two opposite sides thereof and both wall portions have parts for snapping into a notch.

3. A rotary wafer switch comprising a wafer housing, at least one wafer positioned in a predetermined operative position in the housing, said wafer carrying fixed switch contacts, a rotatable contact carrier, at least one movable switch contact carried by the carrier to co-operate with said fixed switch contacts, and co-operating means on the wafer and on the housing for automatically retaining and positively locating the wafer in said predetermined operative position when the wafer reaches said position in the housing when the wafer is assembled into the housing, said rotatable contact carrier having formed therein a contact housing in which said movable contact is located, said contact housing having an opening at the radially outward end thereof through which a contact can be removed while the contact carrier is in its operative position, said contact housing being one of a plurality of such contact housings formed in and spaced around said contact carrier.

4. A switch as claimed in claim 3 wherein said contact housing has a radially inwardly facing portion which engages with a radially outwardly facing portion of the contact therein when the contact is against the wafer whereby to prevent escape of the contact in the radially outward direction, but to permit removal of the contact from its housing past the engaging portion of the housing and through the opening at the radially outward end of the housing by lifting the contact away from the wafer.

5. A rotary wafer switch comprising a wafer housing, at least one wafer positioned in a predetermined operative position in the housing, said wafer carrying fixed switch contacts, a rotatable contact carrier, at least one movable switch contact carried by the carrier to co-operate with said fixed switch contacts, and co-operating means on the wafer and on the housing for automatically retaining and positively locating the wafer in said predetermined operative position when the wafer reaches said position in the housing when the wafer is assembled into the housing, and wherein said wafer housing has a plurality of portions each adapted to snap resiliently into engagement with a wafer substantially independently of each other, said portions being separated from each other in an axial direction of the switch so as to enable a wafer to be assembled into or removed from one said housing portion without substantially disturbing the retention of a wafer in an adjacent said housing portion.

6. A contact carrier for a rotary wafer switch, comprising a substantially circular body having formed therein a plurality of contact housings spaced around said body, each contact housing being a recess formed in said body, each recess having an opening in an axially facing side of said body, and each recess further having an opening adjacent the radially outward end thereof and a wall portion facing radially inwardly of said circular body, whereby when a contact is located in a said housing the contact is exposed at said axially facing side of the carrier through the first-mentioned opening for electrical contact purposes, is retained against radial movement by said wall portion, and can be removed from said housing through said second-mentioned opening.

* * * * *